US005621511A

United States Patent [19]

Nakayama

[11] Patent Number: 5,621,511

[45] Date of Patent: Apr. 15, 1997

[54] FIXING APPARATUS WITH SHEET INTERVAL ADJUSTMENT AND FIXING INTERRUPTIONS

[75] Inventor: Yuji Nakayama, Kawasaki, Japan

[73] Assignee: Canon Kabushiki Kaisha, Tokyo, Japan

[21] Appl. No.: 424,963

[22] Filed: Apr. 19, 1995

[30] Foreign Application Priority Data

Apr. 21, 1994 [JP] Japan ..... 6-107626
May 18, 1994 [JP] Japan ..... 6-127150

[51] Int. Cl.[6] ..... G03G 15/20
[52] U.S. Cl. ..... 399/44; 399/69
[58] Field of Search ..... 355/285, 290, 355/208; 219/216

[56] References Cited

FOREIGN PATENT DOCUMENTS 60-41050 3/1985 Japan .

*Primary Examiner*—Joan H. Pendegrass
*Assistant Examiner*—Quana Grainger
*Attorney, Agent, or Firm*—Fitzpatrick, Cella, Harper & Scinto

[57] ABSTRACT

The present invention provides a fixing apparatus comprising a heat body heated by a heater and adapted to convey a recording sheet, temperature detection means for detecting a temperature of the heat body, energization control means for controlling energization of the heater in such a manner that a detection temperature detected by the temperature detection means is maintained to a set temperature, and selection means for selecting either extension of a sheet feed interval or temporary interruption of a fixing operation, when the detection temperature detected by the temperature detection means exceeds a predetermined fixing mode change temperature.

11 Claims, 7 Drawing Sheets

FIXING APPARATUS WITH SHEET INTERVAL ADJUSTMENT AND FIXING INTERRUPTIONS

BACKGROUND OF THE INVENTION

1. Field of the Invention

The present invention relates to a fixing apparatus used with an image forming apparatus such as a copying machine, a printer and the like.

2. Related Background Art

In the past, in fixing apparatuses used with an image forming apparatus such as a copying machine, a laser beam printer and the like, toner consisting of resin, magnetic material, coloring agent and the like electrostatically transferred onto a recording sheet at an image forming portion was fixed to the recording sheet by heating and fusing the toner.

FIG. 4 shows an example of a conventional fixing apparatus. This fixing apparatus comprises an upper heat roller 51 and a lower pressure roller 52. The heat roller 51 includes therein a main heater 53*a* and a sub-heater 53*b*. The main heater 53*a* is always used in a fixing operation, but, the sub-heater 53*b* is used only in a start-up operation to shorten a wait up time. The recording sheet P is passed through a fixing nip between the heat roller 51 and the pressure roller 52. The toner 54 transferred from a photosensitive member to the recording sheet P at the image forming portion is electrostatically held on the recording sheet in a non-fixed condition. When the recording sheet P passes through the fixing nip, the toner 54 is heated by the heat roller 51 directly contacting with the toner and is pressurized by the pressure roller 52 urging the recording sheet P against the heat roller 51, with the result that the toner 54 is fused and fixed to the recording sheet by heat and pressure.

If the toner 54 is fixed at a temperature lower than a temperature at which the resin and the like constituting the toner is softened or melt, low temperature offset will occur. That is to say, in the fixing operation, there are optimum upper temperature limit and lower temperature limit. Thus, only when the fixing temperature is controlled within a range between the upper and lower limits, the good fixing can be achieved. The control of the fixing temperature is effected on the basis of a surface temperature of the heat roller 51 detected by a thermistor 55.

However, in the fixing apparatus having the above-mentioned construction, if a copying speed is increased in a continuous copy mode (continuous image forming mode), as the number of copies is increased, a heat amount greater than that supplied from the heat roller 51 is absorbed by the toner 54 and the recording sheet P, with the result that, even when the heater is fully activated, the temperature detected by the thermistor 55 and accordingly the fixing temperature will be decreased. To avoid this, electric power supplied to the main heater 53*a* may be increased. However, in this case, power consumption require by the copying machine (image forming apparatus) is increased, with the result that such image forming apparatus needs more power than is available in typical residences, thereby limiting the installation locations for the image forming apparatus. Further, in recent years, since the improvement in productivity of the copying machines has been required to provide faster copying machines, the percentage of power consumption of the fixing apparatus regarding the total power consumption has been increased. Thus, the specification of the image forming apparatus has been become severe to use the image forming apparatus in the general homes.

To avoid this, there has been proposed a technique in which, when the temperature of the heat roller 51 reaches the lower fixing temperature limit during the continuous copying mode, the copying operation is temporarily stopped and the fixing operation is waiting until the temperature of the heat roller 51 is restored to the optimum temperature.

Alternatively, when the temperature of the heat roller reaches a temperature slightly higher than the lower fixing temperature limit the copy frequency may be extended to decrease the reduction ratio of the fixing temperature (reduction of temperature per each copy), thereby extending the time period reaching the lower fixing temperature limit. In this method for extending the copy frequency, there has been proposed a technique wherein a fixing speed is determined on the basis of the reduction ratio of the fixing temperature and the number of remaining copy sheets to avoid "copy stop". That is to say, during the continuous copying operation, if the fixing temperature is decreased, the copy frequency is suitably extended so that the time period between the copy regarding a certain recording sheet P and the copy regarding a next recording sheet P is set to restore the temperature of the heat roller 51 completely.

However, in the above-mentioned conventional technique, there arose a problem that, in the continuous copy mode, the total copying time for copying all of the sheets which were set as the number of copies is increased. That is to say, since this technique is not a system for controlling the entire copying time to the minimum but is a system for preventing the poor fixing during the continuous copy mode, the total copying time becomes greater than that in a copying machine having the latest copying speed. Thus, the productivity of the copying machine cannot be improved.

SUMMARY OF THE INVENTION

The present invention aims to eliminate the above-mentioned conventional drawbacks, and an object of the present invention is to provide a fixing apparatus which can reduce or shorten the total copying time in a continuous image forming mode (continuous fixing mode).

Another object of the present invention is to provide a fixing apparatus which can effect good fixing in a continuous image forming mode.

A further object of the present invention is to provide a fixing apparatus which comprises a heat body to be heated by a heater, a temperature detecting means for detecting a temperature of the heat body, an energization controlling means for controlling energization of the heater so that the detection temperature detected by the temperature detecting means is maintained to a set temperature, and a selection means for selecting extension of sheet feed interval or temporary interruption of a fixing operation when the detection temperature detected by the temperature detecting means reaches a predetermined fixing mode change temperature during a continuous fixing operation.

A still further object of the present invention is to provide a fixing apparatus which comprises a heat body to be heated by a heater, a temperature detecting means for detecting a temperature of the heat body, an energization controlling means for controlling energization of the heater so that the detection temperature detected by the temperature detecting means is maintained to a set temperature, and a sheet feed interval controlling means for extending sheet feed interval when the detection temperature detected by the temperature detecting means reaches a predetermined fixing mode change temperature during a continuous fixing operation, and wherein the sheet feed interval controlling means controls sheet feed interval after the extension of the sheet feed interval on the basis of a temperature reduction ratio of the heat body and the number of remaining sheets to be copied.

The other objects will be apparent from the following detailed explanation referring to the accompanying drawings.

DETAILED DESCRIPTION OF THE PREFERRED EMBODIMENTS

First Embodiment

Figure 4:
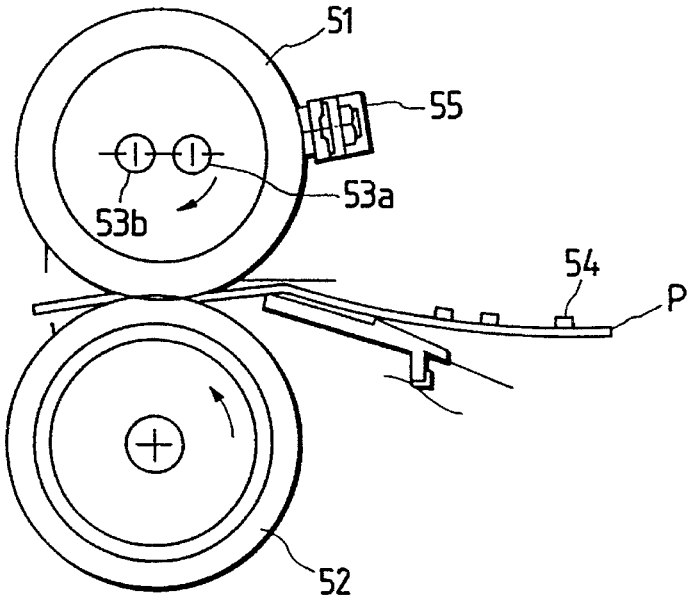
FIG. 4 PRIOR ART
FIG. 4 is a sectional end view of a fixing apparatus according to first to third embodiments of the present invention.
Figure 5:
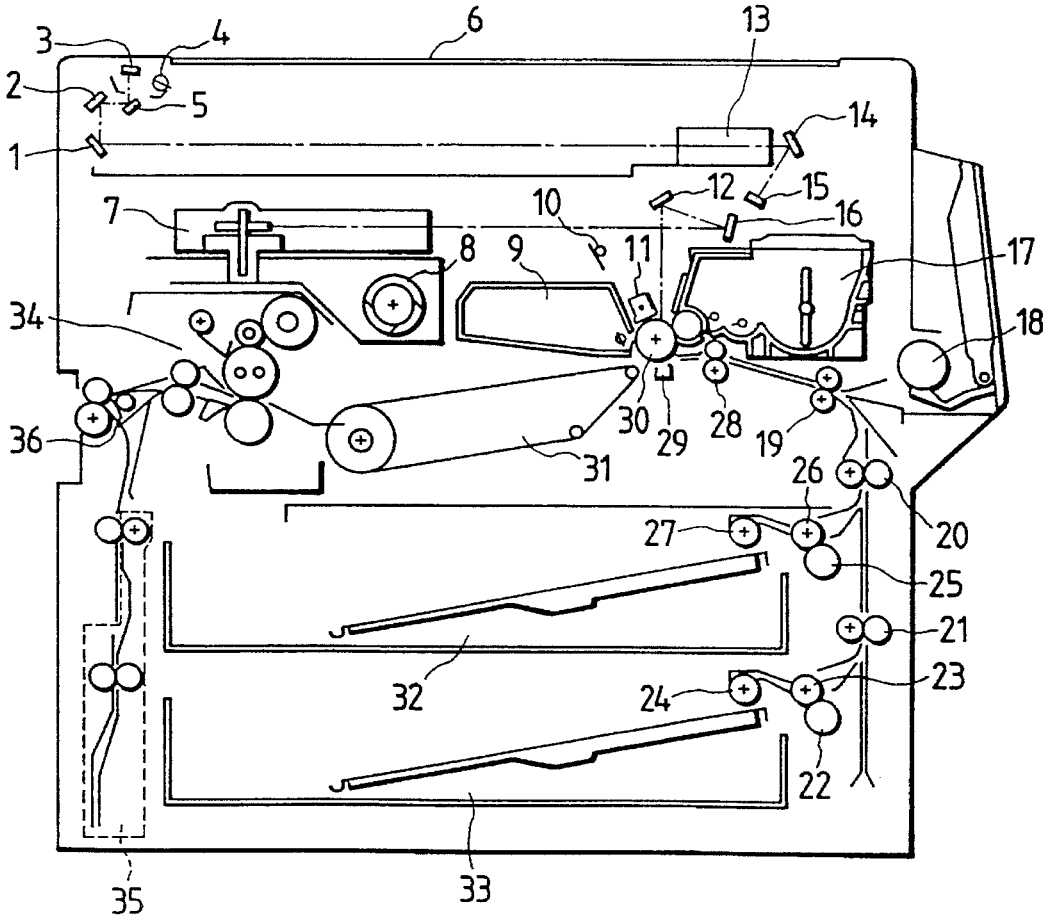
FIG. 5 is an elevational sectional view of a copying machine having a fixing apparatus according to any one of first to sixth embodiments of the present invention.

FIG. 5 is a schematic elevational sectional view of a copying machine (image forming apparatus) having a fixing apparatus according to the present invention. Now, a construction and an operation of the copying machine will be described. Incidentally, since the fixing apparatus according to the first embodiment is the same as that shown in FIG. 4, the same functional elements as those shown in FIG. 4 are designated by the same reference numerals.

A recording sheet P supplied from a cassette 32 (or 33) by a sheet supply roller 27 (or 24) and separated from the other recording sheets by a feed roller 26 (or 23) and a separation roller 25 (or 22) is sent to a pair of regist rollers 28 by means of convey rollers 20, 19 (and 21). Then, the recording sheet P is supplied toward a drum-shaped photosensitive member 37 by the paired regist roller 28 at a predetermined timing.

In FIG. 5, the photosensitive member 37 is rotated in a clockwise direction; meanwhile, a surface of the photosensitive member is uniformly charged by a first charger 11. On the other hand, in synchronous with the charging of the photosensitive member, an original rested on an original support glass 6 is illuminated by light from an original illumination lamp 4, and light reflected from the original is directed to a CCD 15 through a slit 3, a first mirror 5, a second mirror 2, a third mirror 1, a lens 13 and a fourth mirror 14. Thus, image information is read by the CCD 15. When the read image information is electrically treated, laser light corresponding to the image information is emitted from a laser unit 7, so that the uniformly charged photosensitive member 37 is exposed by the laser light incident to the photosensitive member through a first laser mirror 16 and a second laser mirror 12, thereby forming an electrostatic latent image on the photosensitive member.

The electrostatic latent image is visualized with toner from a developing device 17 as a toner image. The toner image on the photosensitive member 37 is transferred onto the recording sheet P supplied to the photosensitive member 37 by the paired regist rollers 28, by means of a transfer charger 29. Excessive charge on the recording sheet P to which the toner image was transferred is removed by an electricity removal probe 30, and then, the recording sheet is sent to a fixing apparatus 34 through a convey portion 31. After the toner image was fixed to the recording sheet P by the fixing apparatus 34 with heat and pressure, the recording sheet is discharged out of the copying machine by a discharge portion 36.

On the other hand, after the toner image was transferred to the recording sheet, the residual toner remaining on the photosensitive member 37 is removed by a drum cleaner 9 having a cleaning blade, and then, the photosensitive member is illuminated by a pre-exposure lamp 10 to be prepared for a next image formation (next copy).

Incidentally, in FIG. 5, the reference numeral 18 denotes a manual sheet insertion portion; 8 denotes an exhaust fan; and 35 denotes a discharge vertical path portion.

Figure 2:
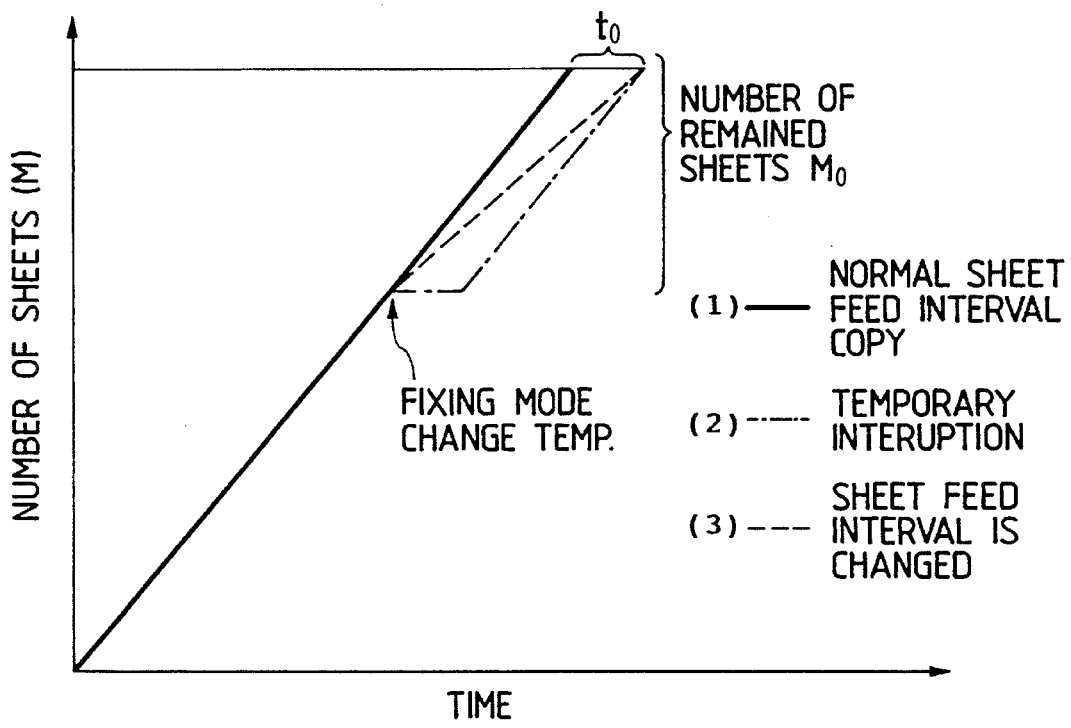
FIG. 2 is a graph showing a relation between a copying time and the number of copy sheets according to the first embodiment.

FIG. 2 is a graph showing a relation between a copying time and the number of copy sheets.

In FIG. 2, the solid line (1) shows a graph obtained under normal sheet feed interval copy, the dot and chain line (2) shows a graph obtained when the copy is temporarily interrupted at a predetermined fixing mode change temperature, and the broken line (3) shows a graph obtained when the sheet feed interval is changed (extended) during the copying operation.

As seen from FIG. 2, when the main heater **53*a* and the sub-heater 53*b* in the heat roller 51 (FIG. 4) are activated after the temperatures of the heat roller and the pressure roller is decreased during the continuous copying operation to reach a predetermined fixing mode change temperature $T_2$, a time period (temporary interruption time period) $t_0$ is required until the predetermined fixing mode change temperature $T_2$ is increased to a fixing temperature $T_1$. To the contrary, when the sheet feed interval is extended without temporary interruption, the total copying time regarding the total number of sheets to be copied becomes greater than the total copying time under the condition shown in the graph (2**) (temporary interruption) if the number of remaining sheets to be copied is greater than $M_0$ immediately after the temperature of the heat roller is decreased to the temperature $T_2$.

Figure 1:
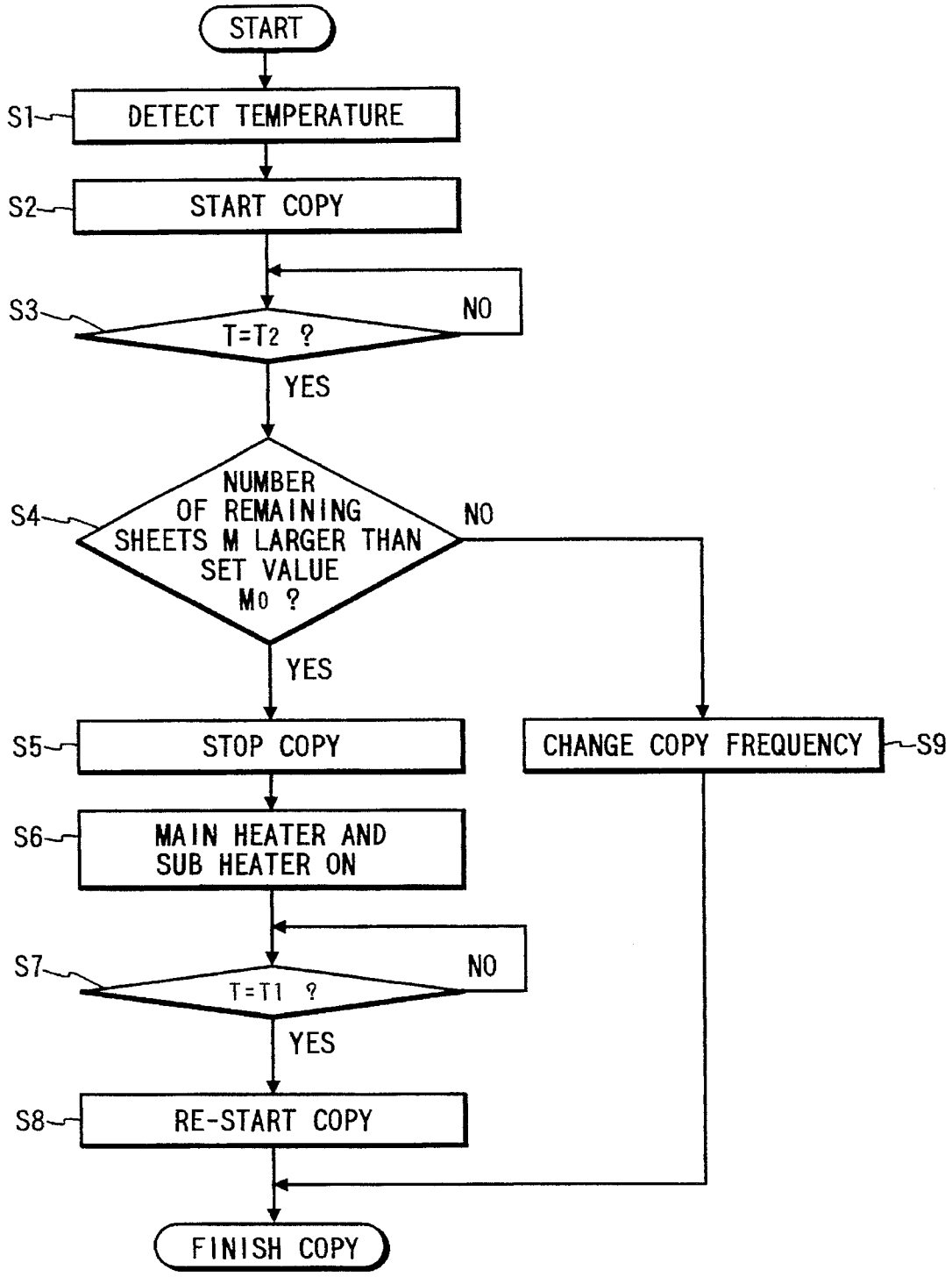
FIG. 1 is a flow chart for controlling sheet feed interval in a fixing apparatus according to a first embodiment of the present invention.

Now, a control method for minimizing the copying time in the continuous copying mode will be explained with reference to a flow chart shown in FIG. 1.

In a stand-by condition of the copying machine, the fixing temperature $T_1$ is under the temperature control (step S1).

The originals are set, the number of sheets to be continuously copied is set, and a copy start button is depressed (step S2). When the images on the originals are successively copied on the recording sheets P and the recording sheets are successively passed through the nip of the heat body (heat roller 51 and pressure roller 52), the surface temperatures T of the heat roller 51 and the pressure roller 52 are gradually decreased. When the temperature T reaches the predetermined fixing mode change temperature $T_2$ (step S3), it is judged whether the number M of remaining sheets is greater than a value $M_0$ which was previously determined for each of sheet sizes (step S4). If the number M of remaining sheets is smaller than the value $M_0$, the sheet feed interval is extended (step S9), and the copying operation is continued. On the other hand, if the number M of the remaining sheets is greater than the value $M_0$, the copying operation (fixing operation) is temporarily interrupted (step S5). By the temporary interruption, it is not required to supply the electric power to the original illumination lamp 4 and the like, and such electric power is supplied to the main heater 53*a* and the sub-heater 53*b* (step S6). When the detection temperature T detected by the thermistor 55 reaches the fixing temperature $T_1$ (step S7), the copying operation is re-started (step S8).

In this way, by selecting the extension of the sheet feed interval or the temporary interruption of the copying operation (fixing operation) in accordance with the number M of remaining sheets by means of a selection means (not shown), the continuous image formation can be finished at the minimum time, and, when the copying operation is temporarily interrupted, the fixing operation can be effected under the best condition.

Second Embodiment

Next, a second embodiment of the present invention will be explained. The temperature of the pressure roller 52 is greatly decreased in the initial condition of the continuous copying operation, such as, immediately after the copying machine is powered on or when the input electric power voltage is in the lower limit of the reference voltage. Further, during the continuous copying operation, when the thermistor detection temperature T is decreased to the fixing mode change temperature $T_2$, the temporary interruption of the copying operation is selected by the selection means to restore the thermistor detection temperature to the fixing temperature $T_1$. In this case, when the copying operation is re-started, even if a temperature surrounding the fixing apparatus is low, the pressure roller is not sufficiently warmed up, so that the thermistor detection temperature is often quickly decreased to the fixing mode change temperature $T_2$.

In such a case, during the temporary interruption, when the main heater 53*a* and the sub-heater 53*b* are activated, the fixing drive portion is operated to rotate the pressure roller 52. As a result, the temperature of the interior of the pressure roller approaches the surface temperature of the pressure roller to effectively accumulate the heat within the pressure roller. However, when the fixing drive portion is operated to idly rotate the fixing apparatus, the time period $(t_0+t_1)$ during which the temperature $T_2$ reaches the fixing temperature $T_1$ becomes longer, by $t_1$, than the case where the pressure roller 52 is stopped in the first embodiment.

Figure 3:
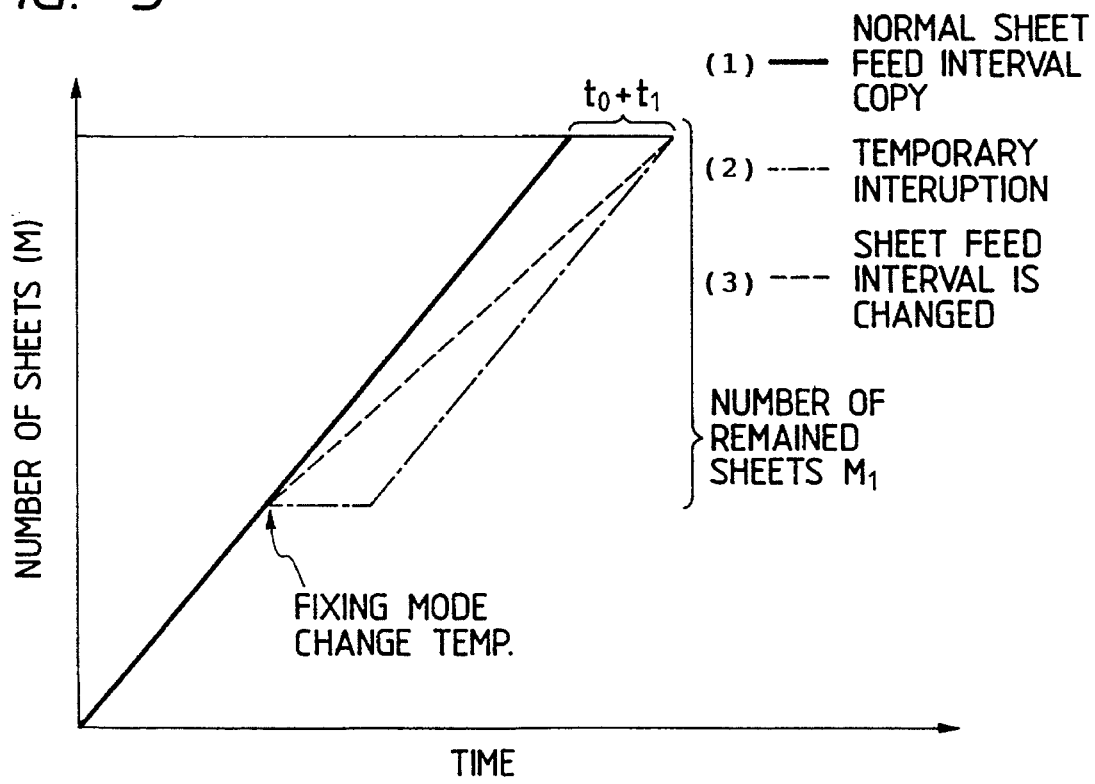
FIG. 3 is a graph showing a relation between a copying time and the number of copy sheets according to a second embodiment of the present invention.

However, as shown in FIG. 3, during the continuous copying operation, when the surface temperature of the heat roller reaches the temperature $T_2$ and the temporary interruption is selected, this is possible since the number of times that the thermistor detection temperature reaches the change temperature $T_2$ can be decreased. Upper limit value $M_1$ of the number of the remaining sheets can be increased by idly rotating the fixing apparatus during the temporary interruption, even when the number of sheets to be continuously copied is considerably great.

In this way, by idly rotating the fixing apparatus during the temporary interruption, it is possible to accumulate the heat within the pressure roller 52, and, thus, the temperature reduction ratio after the re-start of the copying operation can be minimized.

Third Embodiment

Next, a third embodiment of the present invention will be explained. In the first embodiment, when the copying operation is temporarily interrupted, while an example that the apparatus is waiting for the time $t_0$ until the temperature $T_2$is restored to the fixing temperature $T_1$ was explained, the copying operation may be temporarily interrupted for a time $T_3$ that the total copying time becomes equal to or smaller than the total copying time obtained when the sheet feed interval is changed, and, then, the copying operation may be effected under the extended sheet feed interval. In this case, the time $T_3$ is determined on the basis of the number of remaining sheets. When it is assumed that a temperature of the heat roller obtained after the temporary interruption of the time $t_3$ is $T_3$, since $t_3<t_0$, although the temperature of the heat roller is not completely restored to the fixing temperature $T_1(T_2<T_3<T_1)$, the fixing operation can be effected under more optimum fixing temperature in comparison with the case where the sheet feed interval is changed, and total copying time can be reduced.

Next, an apparatus for preventing a bad feeling from affecting to the operator by reducing the times that the temperature of the heat body reaches the fixing mode change temperature and reducing the times that the recording sheet discharge interval is changed will be explained.

Fourth Embodiment

Now, a fourth embodiment of the present invention will be explained with reference to FIGS. 6 to 8.

Incidentally, since an image forming apparatus using a fixing apparatus according to the fourth embodiment is the same as the image forming apparatus shown in FIG. 5, explanation thereof will be omitted.

Figure 6:
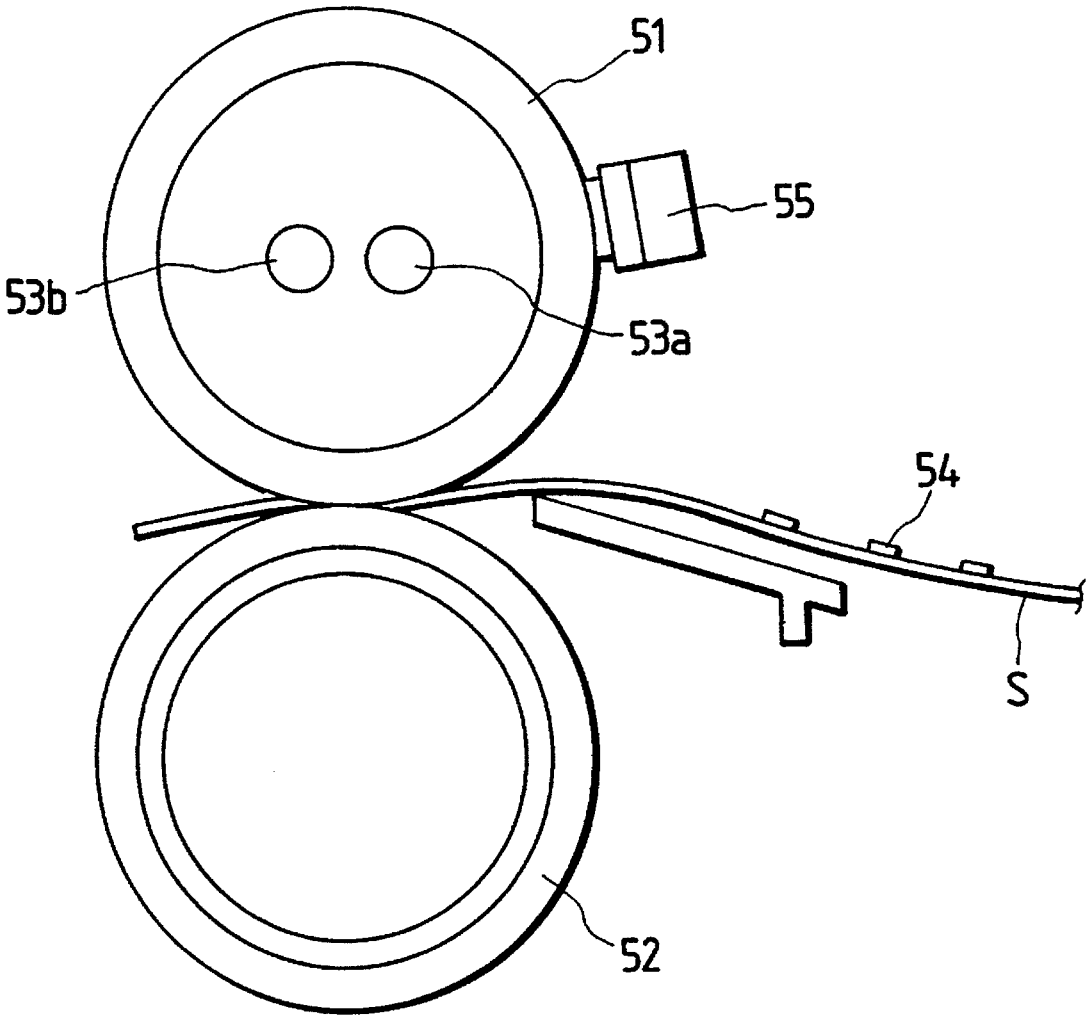
FIG. 6 is a sectional end view of a fixing apparatus according to the fourth to sixth embodiments.

The fixing apparatus according to the fourth embodiment has a construction shown in FIG. 6, and, thus, comprises a pair of heat roller 51 and pressure roller 52, a thermistor (temperature detection means) 55, and a main heater 53*a* and a sub-heater 53*b* (heat source). The fixing apparatus is temperature-controlled to a predetermined temperature by a temperature control means such as a CPU.

In the fixing apparatus having the above-mentioned construction, the continuous copying operation can be performed. However, when the continuous fixing operation is effected by the fixing apparatus 34, since the thermistor detection temperature is decreased to cause the poor fixing, in the illustrated embodiment, if the detection temperature is decreased to a predetermined temperature, the copy frequency (sheet feed interval) is changed by a frequency change means (sheet feed interval control means) such as a CPU, thereby suppressing the reduction of temperature.

However, when the fixing operation is continued under the condition that the copy frequency is extended, since the detection temperature is gradually increased, the copy frequency must be returned to the initial value. And, the copy frequency is returned to the initial value, the temperatures of the paired rollers are decreased again as mentioned above. Accordingly, when the temperature reduction ratio is great, if the timing for returning the copy frequency is not correct, there arises a problem that the copy frequency is changed frequently.

The temperature reduction ratio is changed on the basis of various conditions such as fluctuation of the input power source voltage, environment (temperature and humidity) where the image forming apparatus is installed, density of the original, physical property of the recording sheet (thickness, density, moisture, surface condition, kind and ratio of size additive agent, and material), dimension of the recording sheet, temperature of the pressure roller, size of the nip and the like. Particularly, the temperature reduction ratio of the fixing temperature greatly depends upon the temperature of the pressure roller. That is to say, the temperature reduction ratio is great until the temperature of the pressure roller is saturated; but, thereafter, the temperature of the pressure roller is saturated; but, thereafter, the temperature reduction ratio is gradually decreased, and, since further temperature reduction ratio is determined by the number of remaining sheets, the timing for returning the copy frequency cannot be set to a constant time period.

Thus, in the illustrated embodiment, a measurement point is set to a temperature slightly greater than a predetermined temperature for changing the copy frequency (referred to as "fixing mode change temperature" hereinafter), and, the reduction ratio of the detection temperature in the normal copy frequency is calculated on the basis of a difference between the measurement point and the fixing mode change temperature and a difference between the number of sheets copied until the measurement point is achieved and the number of sheets copied until the fixing mode change temperature is achieved (temperature difference/number of copied sheets), thereby changing (extending) the copy frequency. After the change of the copy frequency, the increased temperature of the heat roller is continuously detected. A value obtained by multiplying the number of remaining sheets at the temperature detection by the temperature reduction ratio is added to the fixing mode change temperature to determine a target temperature. When the detection temperature reaches the target temperature, the copy frequency is returned to the normal value.

Accordingly, even after the copy frequency is returned to the normal value and the remaining sheets are copied, the surface temperature of the roller is greater than the fixing mode change temperature. Thus, during the treatment of the remaining sheets, the change of the copy frequency is not required.

Figure 7:
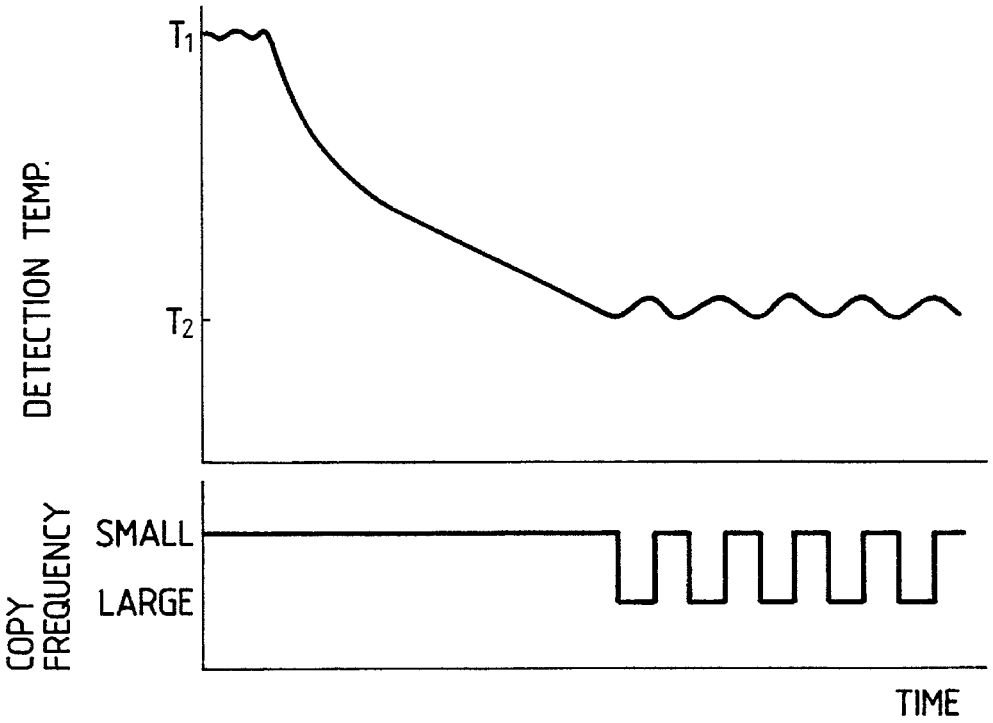
FIG. 7 is a graph showing a thermistor detection temperature and copy frequency in a conventional continuous copy mode.
Figure 8:
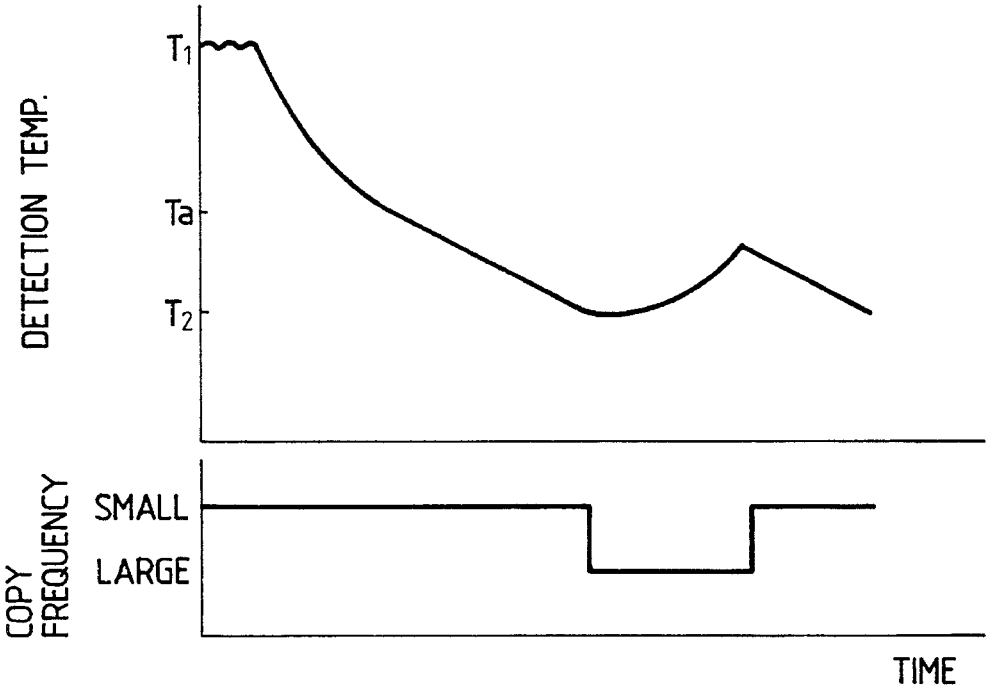
FIG. 8 is a graph showing a thermistor detection temperature and copy frequency in a continuous copy mode according to the present invention.

FIG. 7 is a graph showing the change in the thermistor detection temperature and the change in the copy frequency (sheet feed interval) under the conventional control method in which the sheet feed interval is returned to the normal condition as soon as the detection temperature is increased after the extension of the sheet feed interval, and FIG. 8 is a graph showing the change in the thermistor detection temperature and the change in the copy frequency under the copy frequency change control according to the illustrated embodiment. Incidentally, in FIGS. 7 and 8, the numbers of sheets to be continuously copied are the same.

In FIGS. 7 and 8, $T_1$ is a temperature at the start of the fixing operation, $T_2$ is the fixing mode change temperature, and Ta is the measurement point temperature. As seen from FIGS. 7 and 8, according to the illustrated embodiment, the copying time can be reduced without repeating the useless change in copy frequency.

Figure 9:
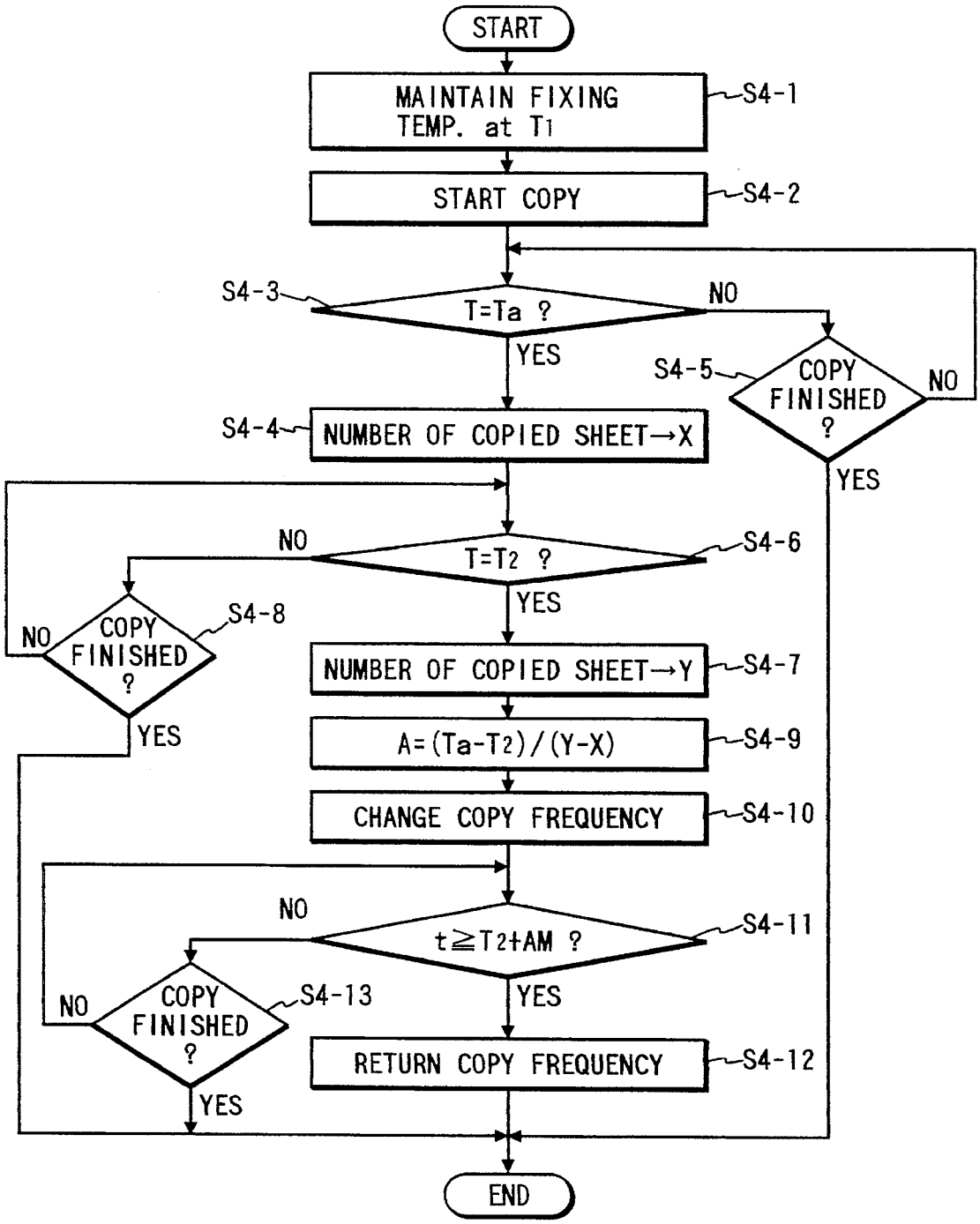
FIG. 9 is a flow chart showing a change control for copy frequency (sheet feed interval) according to the fourth embodiment.

Now, the copy frequency change control according to the illustrated embodiment will be explained with reference to a flow chart shown in FIG. 9. First of all, in a stand-by condition of the copying machine, the fixing temperature $T_1$ is under the temperature control (step S4-1). The originals are set, the number of sheets to be continuously copied is set, and a copy start button is depressed (step S4-2). As a result, the supply of the recording sheet P, image forming operation and fixing operation as mentioned above are performed. As the fixing operation is continuously effected, the temperatures of the paired fixing rollers are gradually decreased. Thus, it is continuously judged whether the detection temperature reaches the measurement point temperature Ta (step S4-3). If the detection temperature reaches the measurement point temperature Ta, the number X of the copied sheets at the point is stored (step S4-4). 0n the other hand, if the copying operation is finished before the detection temperature reaches the measurement point temperature Ta, the number of copies sheets is not stored (step S4-5).

Then, it is judged whether the detection temperature reaches the change temperature $T_2$ for changing the copy frequency (step S4-6). If the detection temperature reaches the change temperature $T_2$, the number Y of the copied sheets at that point is stored (step S4-7). On the other hand, if the copying operation is finished before the detection temperature reaches the change temperature $T_2$, the number of copies sheets is not stored (step S4-8).

The temperature reduction ratio $A=(Ta-T_2)/(Y-X)$ is calculated on the basis of the numbers X, Y of the copies sheets at the measurement point temperature Ta and the change temperature $T_2$ and the difference in temperature between the temperatures Ta, $T_2$, and the calculated value A is stored (step S4-9). Then, the copy frequency is, increased (step S4-10).

As a result of the extension of the sheet feed interval, since the detection temperature is increased, whenever the detection temperature t is changed, the target temperature is calculated by adding the value obtained by multiplying the number of remaining sheets at that point by the temperature reduction ratio A to the change temperature, and the target temperature is compared with the detection temperature (step S4-11). If the detection temperature t is greater than the target temperature, the copy frequency is returned (S4-12). On the other hand, if the copying operation is finished before the temperature t reaches the target temperature, the copy frequency is not returned (step S4-13 ).

In this way, by determining the timing for returning the copy frequency to the initial condition on the basis of the temperature reduction ratio before the change of the copy frequency (sheet feed interval), the copying time can be reduced without repeating the useless change in copy frequency.

Incidentally, since the target value obtained by adding the change temperature $T_2$ to the value AM (the number M of remaining sheets×the temperature reduction ratio A) is not preferable to exceed the fixing temperature $T_1$ at the start of the fixing operation as shown in FIG. 8, when the number of sheets to be copied is so great that the target temperature exceeds the fixing temperature $T_1$, an upper limit of the target temperature may be set.

Further, since the greater the number of sheets to be copied the greater the temperature reduction ratio is decreased, it is preferable that the temperature reduction ratio is continuously corrected.

Fifth Embodiment

Next, a fifth embodiment of the present invention will be explained with reference to a flow chart shown in FIG. 10. Incidentally, explanation common to the fourth embodiment will be omitted.

Figure 10:
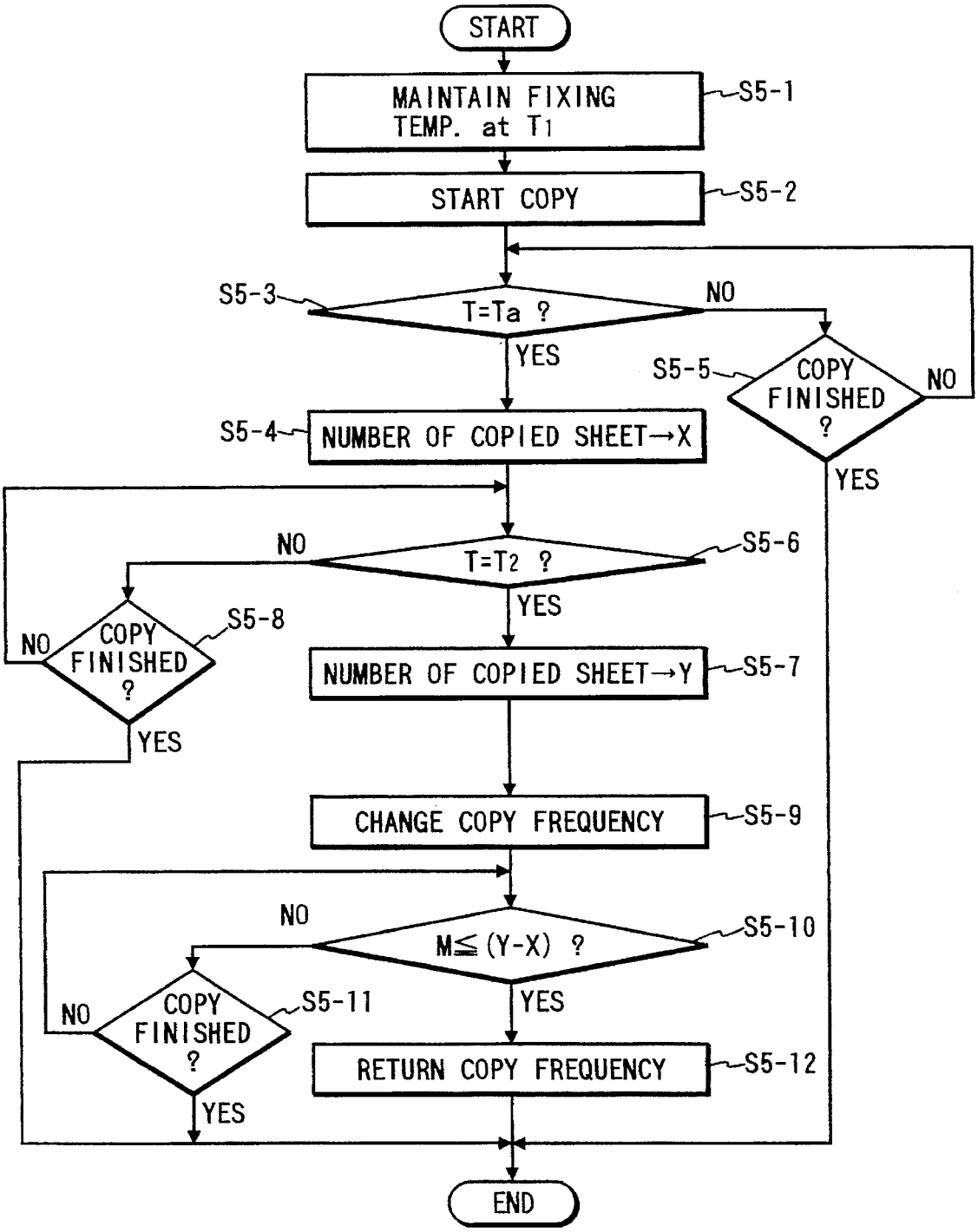
FIG. 10 is a flow chart showing a change control for copy frequency (sheet feed interval) according to the fifth embodiment.

As shown in FIG. 10, also in this embodiment, in a stand-by condition of the copying machine, the fixing temperature $T_1$ is under the temperature control (step S5-1). The originals are set, the number of sheets to be continuously copied is set, and a copy start button is depressed (step S5-2). As a result, the supply of the recording sheet P, image forming operation and fixing operation as mentioned above are performed. As the fixing operation is continuously effected, the temperatures of the paired fixing rollers are gradually decreased. Thus, it is continuously judged whether the detection temperature reaches the measurement point temperature Ta (step S5-3). If the detection temperature reaches the measurement point temperature Ta, the number X of the copied sheets at that point is stored (step S5-4). On the other hand, if the copying operation is finished before the detection temperature reaches the measurement point temperature Ta, the number of copied sheets is not stored (step S5-5).

Then, it is judged whether the detection temperature reaches the change temperature $T_2$ for changing the copy frequency (step S5-6). If the detection temperature reaches the change temperature $T_2$, the number Y of the copied sheets at that point is stored (step S5-7). On the other hand, if the copying operation is finished before the detection temperature reaches the change temperature $T_2$, the number of copies sheets is not stored (step S5-8).

At the same time when the number Y of the copied sheets is stored, the copy frequency is changed to be large (step S5-9). After the change of the copy frequency, when the detection temperature is increased to reach the measurement point temperature Ta again, the number M of remaining sheets at that point is compared with the difference (Y−X) between the number X of the copied sheets at the measurement point temperature Ta and the number Y of copied sheets at the copy frequency change temperature $T_2$ (step S5-10). If $M \leqq (Y-X)$, the copy frequency is returned (step S5-12). On the other hand, if the copying operation is finished within the condition of $M > (Y-X)$, the copy frequency is not returned (step S5-11).

Incidentally, the measurement point temperature Ta may be changed independence upon the set value for the total number of sheets to be copied.

Sixth Embodiment

Next, a sixth embodiment of the present invention will be explained. Incidentally, explanation common to the above embodiments will be omitted.

In the fourth and fifth embodiments, while an example that the measurement point temperature Ta is set to be higher than the change temperature $T_2$ for changing the copy frequency was explained, in order to make simpler, the measurement point temperature Ta may be provided. In this case, after the copy frequency is changed, the copy frequency is not changed until the detection temperature reaches a certain temperature $T_3$ to prevent the frequent change of the copy frequency. Alternatively, after the copy frequency is changed, the copy frequency is not changed until a certain number m of sheets are treated.

As mentioned above, during the continuous copying operation, when the fixing apparatus reaches the fixing mode change temperature, by selecting the condition that the copy frequency is changed and the copying operation is continued or the condition that the copying operation is temporarily interrupted until the fixing temperature is restored and then the copying operation is re-started, the total copying time can be reduced, and, the fixing operation can be effected under the more optimum fixing condition when the temporary interruption is selected.

Further, during the continuous copying operation, when the temperatures of the paired rollers are decreased, since the timing for returning the copy frequency is determined on the basis of the temperature reduction ratio before the change of the copy frequency and the number of remaining sheets, the useless copy treatment time can be eliminated and the frequent changes of the copy frequency affording the bad feeling to the operator can be prevented.

The present invention is not limited to the above-mentioned embodiments, and various alterations can be effected within the scope of the present invention.

What is claimed is:

1. A fixing apparatus, comprising:

a heating member for heating an image on a sheet;

temperature detecting means for detecting temperature of said heating member;

power supply control means for controlling a power supply to said heating member so that a detection temperature detected by said temperature detection means is maintained to a set temperature; and selection means for selecting one of an extension of a sheet feed interval and a temporary interruption of a fixing operation, when the detection temperature detected by said temperature detection means is reduced to a predetermined fixing mode change temperature during a fixing.

2. A fixing apparatus according to claim 1, wherein said selection means selects either the extension of the sheet feed interval or the temporary interruption of the fixing operation on the basis of the number of remaining recording sheets, when the detection temperature detected by said temperature detection means is reduced a predetermined fixing mode change temperature.

3. A fixing apparatus according to claim 2, wherein said selection means selects the extension of the sheet feed interval when the number remaining recording sheets is smaller than a predetermined value $M_0$, and selects the temporary interruption of the fixing operation when the number remaining recording sheets is greater than the predetermined value $M_0$.

4. A fixing apparatus according to claim 3, wherein the predetermined values $M_0$ are set for each of sizes of the recording sheets.

5. A fixing apparatus according to claim 1, wherein said heating member has a pair of rollers which are to be rotated during the temporary interruption, when said selection means selects temporary interruption of the fixing operation.

6. A fixing apparatus according to claim 1, wherein, when said selection means selects temporary interruption of the fixing operation, an interruption time period is changed in accordance with the number of remaining recording sheets when the detection temperature detected by said temperature detection means is reduced the predetermined fixing mode change temperature; and, after the temporary interruption is finished, the fixing operation is re-started with the extended sheet feed interval.

7. A fixing apparatus according to claim 1, wherein the fixing apparatus is used with an image forming apparatus for forming a toner image on a recording sheet.

8. A fixing apparatus, comprising:

a heating member for heating an image on a sheet temperature detection means for detecting a temperature of said heating member;

power supply control means for controlling a power supply to said heater so that a detection temperature detected by said temperature detection means is maintained to a set temperature; and sheet feed interval control means for extending a sheet feed interval when the detection temperature detected by said temperature detection means reaches a predetermined fixing mode change temperature, said sheet feed interval control means controlling a timing for returning the sheetfeed interval to an initial amount after the extension of the sheet feed interval, based on a temperature reduction ration of said heating member and the number of remaining recording sheets.

9. A fixing apparatus according to claim 8, wherein the temperature reduction ratio is calculated until the detection temperature detected by said temperature detection means is decreased from the set temperature to the predetermined fixing mode change temperature.

10. A fixing apparatus according to claim 8, wherein the temperature reduction ratio corresponds to the number of recording sheets copied until the temperature of said heating member is decreased from a first temperature to a second temperature.

11. A fixing apparatus according to claim 8, wherein the fixing apparatus is used with an image forming apparatus for forming a toner image on a recording sheet.

* * * * *

UNITED STATES PATENT AND TRADEMARK OFFICE

CERTIFICATE OF CORRECTION

PATENT NO. : 5,621,511

DATED : April 15, 1997

INVENTOR(S) : Yuji NAKAYAMA

It is certified that error appears in the above-indentified patent and that said Letters Patent is hereby corrected as shown below:

COLUMN 1

Line 39, delete "melt" and insert therefor --melts--;
Line 58, delete "require" and insert therefor --required--.

COLUMN 4

Line 1, delete "synchronous" and insert therefor --synchronism--.

COLUMN 6

Line 3, delete "Upper" and insert therefor --The upper--;
Line 36, delete "to".

COLUMN 8

Lines 22, 31 and 33, delete "copies", each occurrence, and insert therefor --copied--.

COLUMN 9

Line 35, delete "copies" and insert therefor --copied--;
Line 50, delete "independence" and insert therefor --independently--.

UNITED STATES PATENT AND TRADEMARK OFFICE

CERTIFICATE OF CORRECTION

PATENT NO. : 5,621,511

DATED : April 15, 1997

INVENTOR(S) : Yuji NAKAYAMA

It is certified that error appears in the above-indentified patent and that said Letters Patent is hereby corrected as shown below:

COLUMN 10

Line 45, after "reduced", insert --to--;
Lines 49 and 52, after "number", both occurrences, insert --of--;
Line 55, delete "sizes" and insert therefor --size--.

COLUMN 12

Line 1, delete "sheetfeed" and insert therefor --sheet feed--;
Line 3, delete "ration" and insert therefor --ratio--.

FIGURES 2 and 3

Delete "INTERUPTION" and insert therefor --INTERRUPTION--.

Signed and Sealed this

Ninth Day of December, 1997

*Attest:*

*Attesting Officer*

BRUCE LEHMAN

*Commissioner of Patents and Trademarks*